United States Patent [19]

Shimoya et al.

[11] Patent Number: 4,692,741

[45] Date of Patent: Sep. 8, 1987

[54] MOTOR ACTUATED BUZZER ASSEMBLY WITH A PLURALITY OF LEAF SPRINGS OF DIFFERENT FREQUENCIES

[75] Inventors: Shigeo Shimoya, Kitamoto; Yutaka Iwasaki, Kumagaya; Tadashi Ishii, Tokyo; Hikoji Iwasaki, Konosu, all of Japan

[73] Assignee: Kobishi Electric Co., Ltd., Tokyo, Japan

[21] Appl. No.: 710,219

[22] Filed: Mar. 11, 1985

[30] Foreign Application Priority Data

Jun. 29, 1984 [JP] Japan ..... 59-98357[U]
Jul. 14, 1984 [JP] Japan ..... 59-106568[U]

[51] Int. Cl.[4] ..... G10K 1/00; G10K 1/08

[52] U.S. Cl. ..... 340/392; 340/396; 340/399; 340/402

[58] Field of Search ..... 340/384 R, 384 E, 392, 340/396, 399–402; 116/148, 152, 155, 156, 159, 164; 267/158, 160

[56] References Cited

U.S. PATENT DOCUMENTS

| | | | |
|---|---|---|---|
| 2,624,226 | 1/1953 | Hansen | 340/392 |
| 3,039,423 | 6/1962 | Warn | 116/155 |
| 3,518,667 | 6/1970 | Hanna et al. | 340/392 |
| 4,286,258 | 8/1981 | Ishii | 340/399 |
| 4,305,066 | 12/1981 | Shimoya | 340/392 |
| 4,306,227 | 12/1981 | Ishii | 340/402 |
| 4,310,834 | 1/1982 | Ishii | 340/392 |
| 4,368,458 | 1/1983 | Ishii | 340/392 |

FOREIGN PATENT DOCUMENTS

| | | | |
|---|---|---|---|
| 2054938 | 2/1981 | United Kingdom . | |
| 2080595 | 2/1982 | United Kingdom . | |
| 2119150A | 11/1983 | United Kingdom | 116/155 |

OTHER PUBLICATIONS

UK Search Report dated Apr. 25, 1985, Issued on Applicants' Corresponding British Patent Application.

*Primary Examiner*—James L. Rowland
*Assistant Examiner*—Brent A. Swarthout
*Attorney, Agent, or Firm*—Cushman, Darby & Cushman

[57] ABSTRACT

A motor actuated buzzer includes a motor mounted on a body, at least one cam member fixedly mounted on an output shaft of the motor, a sound generating plate mounted on the body, and a hammer for striking the sound generating plate, the cam having a plurality of radial protrusions. At least one leaf spring is fixed to the body at one end thereof and urged toward the cam member. The leaf spring carries the hammer intermediate opposite ends thereof and having at a free end thereof a projection. The radial protrusions are engageable with the projection upon rotation of the cam member to oscillate the leaf spring to intermittently bring the hammer into striking contact with the sound generating plate to produce a buzzing sound.

6 Claims, 14 Drawing Figures

MOTOR ACTUATED BUZZER ASSEMBLY WITH A PLURALITY OF LEAF SPRINGS OF DIFFERENT FREQUENCIES

BACKGROUND OF THE INVENTION

1. Field of the Invention

This invention relates to a motor actuated buzzer for an alarm device or a burglar alarm.

2. Prior Art

One conventional buzzer comprises an electromagnet adapted to be excited by either a DC current or an AC current, a sound generating plate, an oscillatory plate carrying a hammer and attracted by the electromagnet to move toward the sound generating plate to bring the hammer into striking contact with the sound generating plate, and a switching means having a first contact mounted on the oscillatory plate and a second contact mounted on a buzzer body, the first contact being moved away from the second contact when the oscillatory plate is moved toward the sound generating plate to de-energize the electromagnet. With this conventional buzzer, the spacing between the first and second contacts as well as the spacing between the oscillatory plate and the electromagnet need to be accurately predetermined so that the oscillatory plate can be operated properly to produce a buzzing sound of a desired volume.

The conventional buzzer has the following disadvantages:

(a) When the buzzer is used over a long period of time, the oscillatory plate, the electromagnet and the sound generating plate become displaced with respect to one another since the buzzer is subjected to vibration during the operation, so that the spacing between the electromagnet and the oscillatory plate as well as the spacing between the first and second contacts is changed. As a result, the volume of the buzzing sound produced may be varied, and in the worst case the oscillatory plate fails to produce a buzzing sound, (b) A delicate adjustment is required in assembling the buzzer so that the above-mentioned component parts are accurately positioned with respect to one another.

(c) When the buzzer is used in those places, such as a factory and a plant, where a power voltage for the buzzer is subjected to a fluctuation, the oscillatory movement of the oscillatory plate tends to becomes unstable or to be stopped.

(d) When the oscillatory plate is used for a long period of time, it is subjected to fatigue and may finally be subjected to damage or breakage.

SUMMARY OF THE INVENTION

It is therefore an object of this invention to provide a motor actuated buzzer which can produce a buzzing sound of a desired volume for a long period of time in a stable manner, requires no delicate adjustment when assembling the buzzer, and is not affected by a fluctuation in the power voltage.

According to the present invention, there is provided a motor actuated buzzer comprising:

(a) a body;

(b) a motor mounted on the body and having a rotatable output shaft;

(c) cam means comprising at least one cam member fixedly mounted on the output shaft and having a plurality of radial protrusions;

(d) a sound generating plate mounted on the body;

(e) a hammer for striking the sound generating plate; and (f) resilient means comprising at least one leaf spring fixed to the body at one end thereof and urged toward the cam member, the leaf spring carrying the hammer intermediate opposite ends thereof and having at a free end thereof a projection, the radial protrusions being engageable with the projection upon rotation of the cam member to oscillate the leaf spring to intermittently bring the hammer into striking contact with the sound generating plate to produce a buzzing sound.

DESCRIPTION OF THE PREFERRED EMBODIMENTS OF THE INVENTION

Figure 1:
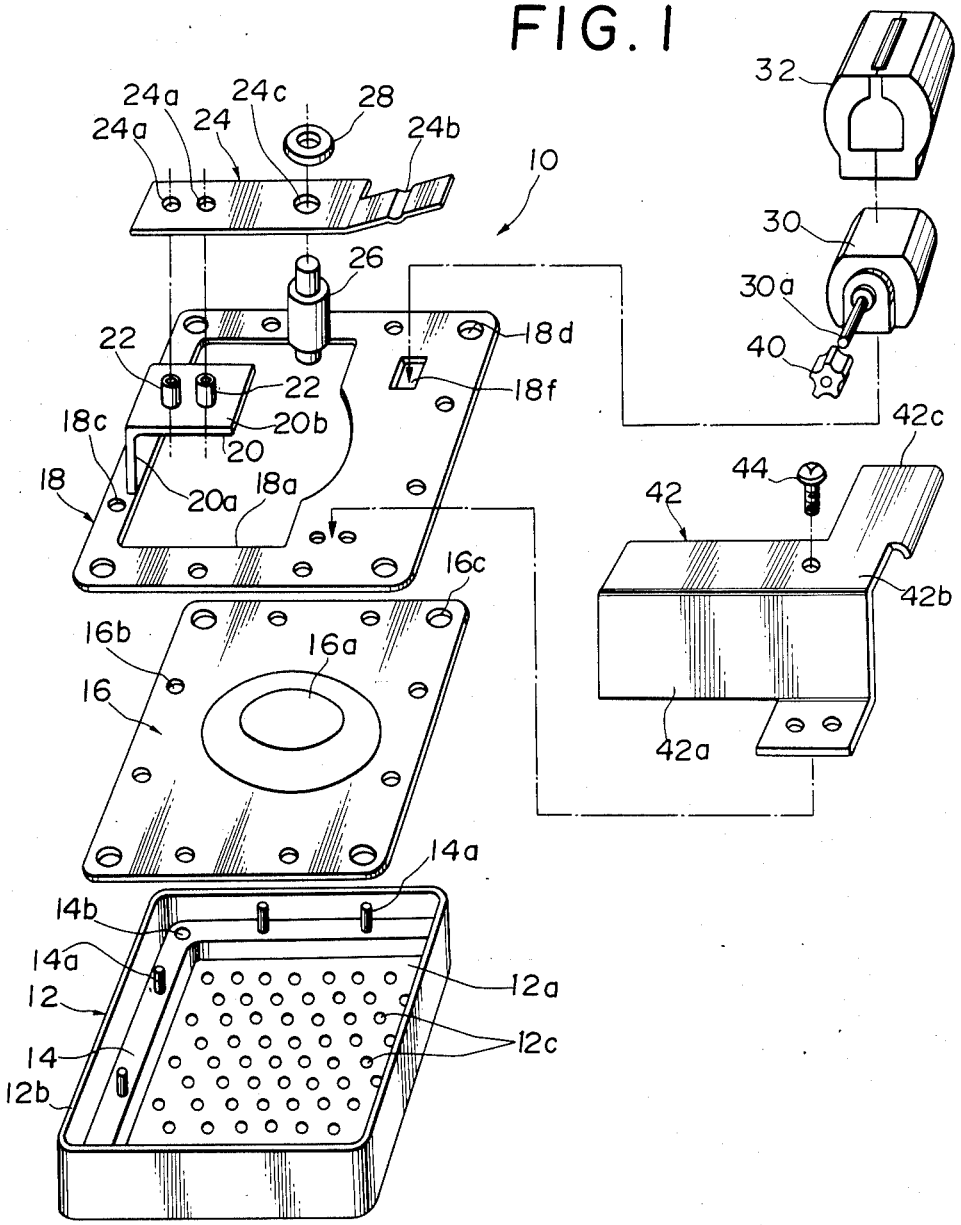
FIG. 1 is an exploded perspective view of a motor actuated buzzer provided in accordance with the present invention.
Figure 2:
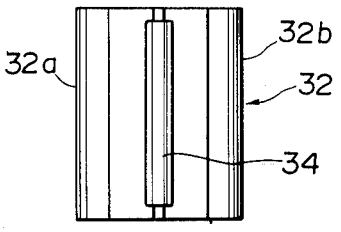
FIG. 2 is a plan view of a motor housing.
Figure 5:
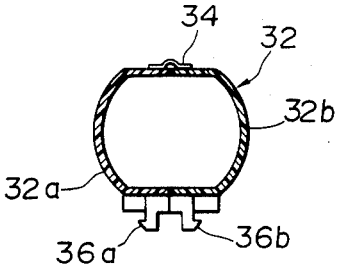
FIG. 5 is a cross-sectional view of the housing.
Figure 3:
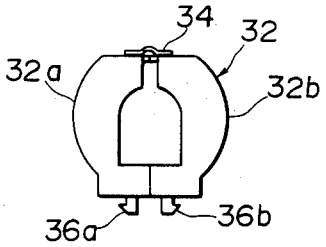
FIG. 3 is a side elevational view of the housing.

A motor actuated buzzer 10 shown in FIG. 1 comprises a casing or body 12 of a rectangular shape having a front wall 12*a* and an open rear 12*b*, the front wall 12*a* having a number of apertures 12*c* for efficiently transmitting a buzzing sound. A rectangular frame 14 of a square cross-section is fitted in and secured to the casing 12, the frame 14 having a plurality of pins 14*a* formed on a surface thereof facing away from the front wall 12*a* and having four holes 14*b* formed in that surface at four corners thereof.

A sound generating plate 16 of a rectangular shape is made of metal such as an aluminum alloy having a central circular raised portion 16*a* drawn out of the plane of the plate 16, the sound generating plate 16 having a plurality of apertures 16*b* formed therethrough at a marginal portion thereof and four apertures 16*c* formed through four corners thereof. The sound generating plate 16 is received in the casing 12 with the pins 14*a* passing through the apertures 16*b*, respectively.

A stamped mounting plate 18 of a rectangular shape is made of metal such as iron and has a generally rectangular opening 18*a* and an L-shaped support portion 20 defined by a first leg 20*a* extending perpendicularly from a marginal portion thereof and a second leg 20*b* extending perpendicularly from the first leg 20*a* at its distal end. The mounting plate 18 has a plurality of apertures 18*c* formed through a marginal portion thereof and four apertures 18*d* formed through four corners thereof. A pair of spaced hollow pins 22 are formed on the second leg 20*b* of the L-shaped support portion 20. The mounting plate 18 is received in the casing 12 and mated with the sound generating plate 16 with the pins 14*a* passing through the apertures 18*c* and pressed at their free ends to join the frame 14, the sound generating plate 16 and the mounting plate 18 together, the raised portion 16*a* extending through the opening 18*a*. A rear plate or lid (not shown) is attached to the rear of the body 12 by screws (not shown) passing through respective aligned apertures 18*d* and 16*c* into the holes 14*b*.

A generally rectangular leaf spring 24 constituting resilient means is made of a resilient material such as steel and has at one end a pair of apertures 24*a* through which the hollow pins 22 extend and pressed at their free ends to hold the leaf spring 24. The free end of the leaf spring 24 is reduced in width and has a transverse projection 24*b* of an arcuate cross-section convex toward the mounting plate 18. A cylindrical hammer member 26 made of plastics material or the like has one end of a reduced diameter passing through an aperture 24*c* in the leaf spring 24 and a washer 28 and fused at a free end thereof to fix it to the leaf spring 24.

A DC motor 30 having a rotatable output shaft 30*a* is housed in a housing 32 of plastics material, and the leaf spring 24 is disposed transversely of the output shaft 30*a*. As best shown in FIGS. 2 to 5, the housing 32 has a generally cylindrical body composed of a pair of semi-cylindrical shells 32*a* and 32*b* connected together at their one lateral marginal portions by a hinge 34. The shells 32*a* and 32*b* have respective pawls or engaging means 36*a* and 36*b* formed integrally on the other lateral marginal portions in opposed relation to each other. Formed through the mounting plate 18 is a square retaining aperture 18*f* into which the opposed pawls 36*a* and 36*b* are snappingly fitted to fix the housing 32 with respect to the mounting plate 18.

Figure 6:
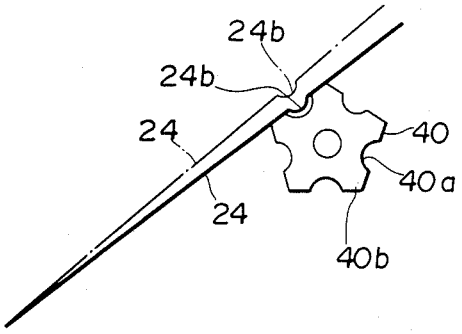
FIG. 6 is a fragmentary side elevational view of the buzzer, showing the engagement of a leaf spring with a cam.
Figure 4:
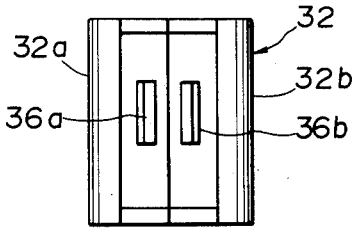
FIG. 4 is a bottom view of the housing.

A cam 40 in the form of a generally pentagonal plate is fixedly mounted on the output shaft 30*a*, and an arcuate recess 40*a* is formed in each of the five sides of the cam 40 and disposed between each adjacent corner portions 40*b* serving as radial protrusions. The radius of curvature of each recess 40*a* is greater than that of the arcuate projection 24*b* of the leaf spring 24, and therefore the projection 24*b* is spaced from the bottom of the recess 40*a* when it is received in the recess 40*a*, as shown in FIG. 6. The free end of the leaf spring 24 resiliently engages the outer periphery of the cam 40, and upon rotation of the cam 40, the leaf spring 24 is caused to oscillate or move between an operative position shown in a solid line in FIG. 6 where the arcuate projection 24*b* is received in the recess 40*a* to allow the hammer 26 to strike the raised portion 16*a* of the sound generating plate 16 and an inoperative position shown in a dash- and-dot line where the arcuate projection 24*b* engages the corner portion 40*b* to move the hammer 26 away from the raised portion 16*a*. By virture of the provision of the arcuate projection 24*b*, the amplitude of oscillation of the leaf spring 24 is increased. The edge into which each recess 40*a* and each corner portion 40*b* merge is chamfered or made smooth to prevent an undue resistance from developing between the edge and the arcuate projection 24*b* during the operation of the buzzer 10.

A holder member 42 of an L-shaped cross-section is secured to the mounting plate 18 by screws (not shown), the holder member 42 having a first leg 42*a* disposed perpendicular to the mounting plate 18 and a second leg 42*b* extending perpendicular to the first leg. An arm 42*c* extends from the second leg 42*b* in coplanar relation thereto to hold the housing 32. A set screw 44 is threaded through the second leg 42*b* and is engageable with the oscillating leaf spring 24 to limit its retracting movement away from the mounting plate 18. With this construction, the volume of the buzzing sound can be changed by adjusting the tightening of the set screw 44.

In the above embodiment, although the frame 14 including the pins 14*a* is made of metal such as aluminum, they may be formed of plastics material, in which case the free ends of the pins 14*a* are fused to connect the frame 14, the sound generating plate 16 and the mounting plate 18 together. The use of the plastics material frame 14 contributes to the production of a buzzing sound of a more mild tone. The arcuate projection 24*b* of the leaf spring 24 is formed by stamping but may be formed by securing a separate projection element to a flat free end.

Figure 7:
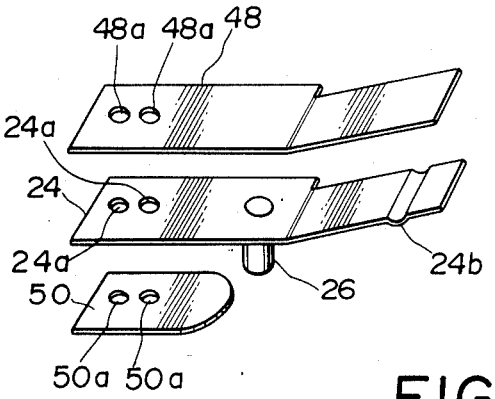
FIG. 7 is a perspective view of a modified leaf spring assembly.
Figure 8:
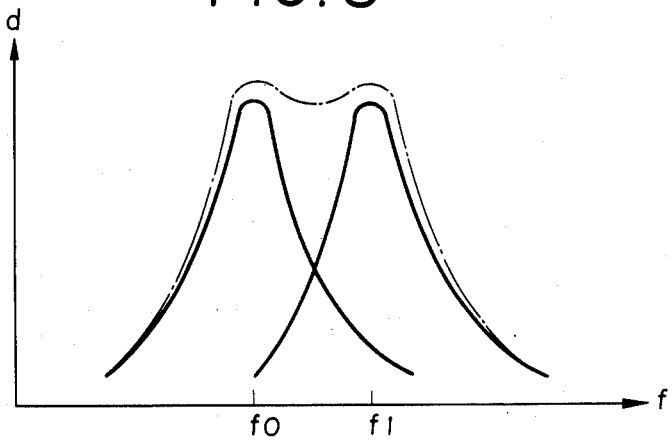
FIG. 8 is an diagramatical illustration showing characteristics of the leaf spring assembly of FIG. 7

According to a modified form of the invention shown in FIG. 7, two additional leaf springs 48 and 50 are mated with the opposite sides of the leaf spring 24 and extend along the length thereof. The pair of hollow pins 22 extend through the apertures 50*a*, 24*a* and 48*a* of the leaf springs 50, 24 and 48. The leaf spring 48 has substantially the same length as the leaf spring 24 while the leaf spring 50 terminates short of the hammer 26. As shown in FIG. 8, the leaf springs 24 and 48 have different natural frequencies f0 and f1, so that the combined frequency of the leaf spring assembly has a wider band as indicated in a dash-and-dot line in FIG. 8. Therefore, even if a power voltage for powering the motor 30 is subjected to a fluctuation to vary the rotation of the motor, the buzzer 10 can always produce a buzzing sound in a stable manner. In addition, the leaf springs can be used for a longer period of time. In this embodiment, the leaf spring 50 may be omitted.

Figure 9:
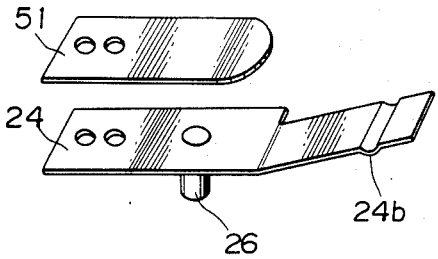
FIG. 9 is a view similar to FIG. 7 but showing another modified leaf spring assembly.

According to another modified form of the invention shown in FIG. 9, a leaf spring 51 is mated with one side of the leaf spring 24 facing away from the hammer 26, the leaf spring 51 extending along the length of the leaf spring 24 only to the proximal end of the free end of a reduced width. This leaf spring assembly can achieve effects similar to the leaf spring assembly shown in FIG. 7.

Figure 10:
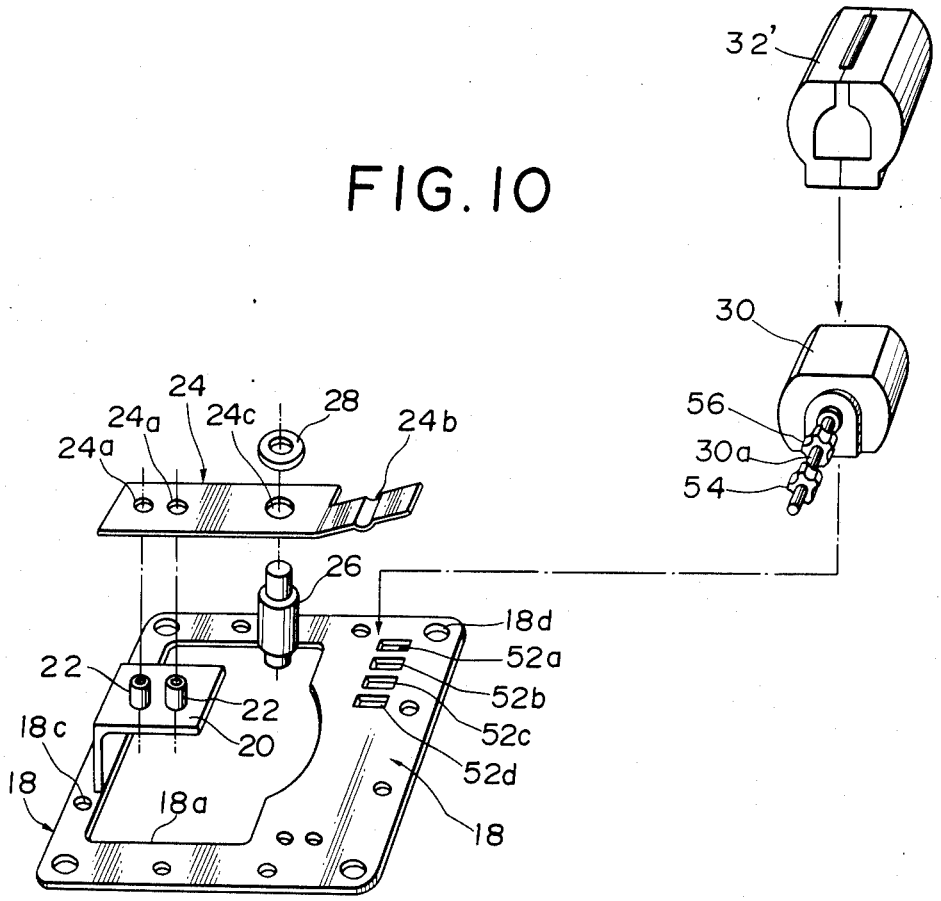
FIG. 10 is a fragmentary perspective view of a modified buzzer.
Figure 11:
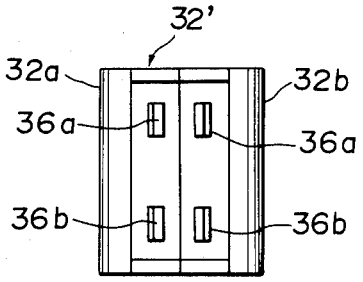
FIG. 11 is a bottom view of a motor housing of the modified buzzer.

A further modified form of the invention shown in FIG. 10 differs from the embodiment of FIG. 1 in that a row of four retaining means or apertures 52*a* to 52*d* are formed through the mounting plate 18 and in that a first cam 56 of a pentagonal shape similar to the cam 40 and a second cam 54 of a square shape are fixedly mounted on the output shaft 30*a* of the motor 30 and are spaced along a length thereof. FIG. 11 is a bottom view of a motor housing 32' which is identical to the motor housing 32 except that two pairs of pawls 36*a* and 36*b* are formed on the bottom of shells 32*a* and 32*b*, the opposed pawls 36*a* and the opposed pawls 36*b* being spaced along the length of the housing 32'. The distance between the first and third retaining apertures 52*a* and 52*c* is equal to the distance between the second and fourth retaining apertures 52*b* and 52*d*. And, the distance between the first and second cams 54 and 56 is equal to the distance between the first and second apertures 52*a* and 52*b*.

With this construction, the housing 32' can be selectively mounted on the mounting plate 18 in either a first mounting position or a second mounting position. More specifically, in the first mounting position, the opposed pawls 36*a* and the opposed pawls 36*b* are snappingly fitted in the first and third retaining apertures 52*a* and 52*c*, respectively, to fix the housing 32' to the mounting plate 18, so that the first cam 54 is so positioned as to be engaged with the free end of the leaf spring 24. On the other hand, in the second mounting position, the opposed pawls 36*a* and the opposed pawls 36*b* are snappingly fitted in the second and fourth retaining apertures 52*b* and 52*d*, respectively, so that the second cam 56 is so positioned as to be engaged with the free end of the leaf spring 24. The first cam 54 of a pentagonal shape can produce a buzzing sound of a higher tone than the second cam 56 of a square shape. Since the housing 32' is mounted on the mounting plate 18 through the snap fit of the pawls 36*a* and 36*b* in the retaining apertures, the housing 32' can be easily changed from the first to the second mounting position and vice versa even on-site.

Figure 12:
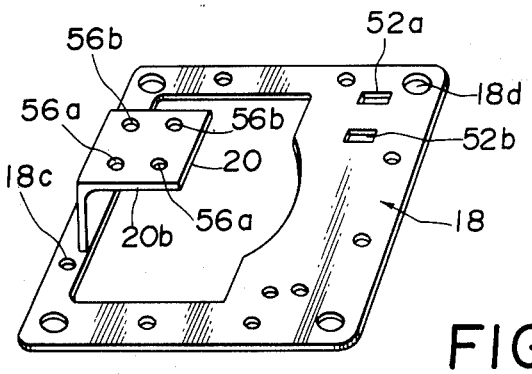
FIG. 12 is a perspective view of a mounting plate of another modified buzzer.
Figure 13:
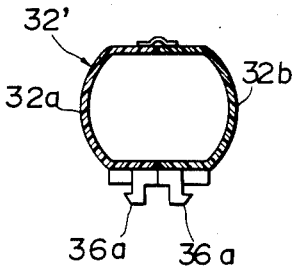
FIG. 13 is a cross-sectional view of a housing of said another modified buzzer.

A still further modified form of the invention shown in FIG. 12 differs from the embodiment shown in FIG. 10 in that the mounting plate 18 has only a pair of retaining apertures 52*a* and 52*b*, that a motor housing 32' (FIG. 13) has only a pair of pawls 36*a* which are snappingly fitted in the retaining apertures 52*a* and 52*b*, and that a first pair of apertures 56*a* and a second pair of apertures 56*b* are formed through a second leg 20*b* of a support member 20 and are spaced along the length of the output shaft 30*a* of the motor 30. With this construction, the leaf spring 24 can be mounted in either a first mounting position or a second mounting position. More specifically, in the first mounting position, the apertures 24*a* of the leaf spring 24 are aligned with the first pair of apertures 56*a* with screws (not shown) passing respectively through these aligned apertures to fix the leaf spring 24 to the mounting plate 18, so that the first cam 54 engages the free end of the leaf spring 24. On the other hand, in the second mounting position, the apertures 24*a* of the leaf spring 24 are aligned with the second pair of apertures 56*b* with the screws passing respectively through these aligned apertures, so that the second cam 56 engages the free end of the leaf spring 24.

Figure 14:
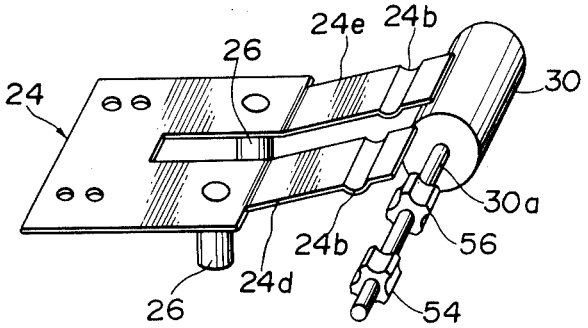
FIG. 14 is an exploded perspective view of a portion of a further modified buzzer showing a leaf spring and a cam.

A further modified form of the invention shown in FIG. 14, differs from the embodiment of FIG. 1 in that a first cam 54 of a pentagonal shape and a second cam 56 of a sqaure shape are fixedly mounted on the output shaft 30*a* of the motor 30 and that a leaf spring 24 is of a generally U-shape having a pair of spaced arms 24*d* and 24*e* each having an arcuate projection 24*b* at its free end. A hammer 26 is secured to each of the arms 24*d* and 24*e*. The free ends of the arms 24*d* and 24*e* resiliently engage the first and second cams 54 and 56, respectively. With this construction, the two hammers 26 are brought into striking engagement with the sound generating plate 16 to produce two kinds of sounds different in frequency from each other, so that a composite sound having a beat frequency of the two frequencies is produced.

What is claimed is:

1. A motor actuated buzzer comprising:

(a) a body;

(b) a motor mounted on said body and having a rotatable output shaft;

(c) cam means comprising at least one cam member fixedly mounted on said output shaft and having a plurality of radial protrusions;

(d) a sound generating plate mounted on said body;

(e) a hammer for striking said sound generating plate; and (f) resilient means comprising a plurality of leaf springs placed one upon the other, each of said springs being fixed to said body at one end thereof and urged toward said cam member, one of said leaf springs carrying said hammer intermediate opposite ends thereof and having at a free end thereof a projection, said radial protrusions being engageable with said projection upon rotation of said cam member, said plurality of leaf springs having such different frequencies that, when said cam member rotates, said plurality of leaf springs cooperate with one another to oscillate as a combined leaf spring which is wider in bandwidth than any one of said plurality of leaf springs, whereby said sound generating plate is intermittently struck by said hammer to produce a buzzing sound.

2. A buzzer according to claim 1, in which said cam means comprises a plurality of cam members fixedly mounted on said output shaft and spaced along a length thereof, said plurality of cam members having different numbers of radial protrusions, and one of said resilient means and said cam means being adjustable to be displaced with respect to the other in the direction of the length of said output shaft so that said projection is engageable with said radial protrusions of one of said cam members.

3. A buzzer according to claim 1, in which said cam means comprises a plurality of cam members fixedly mounted on said output shaft and spaced along a length thereof, said plurality of cam members having different numbers of radial protrusions, said buzzer comprising a plurality of said resilient means corresponding respectively to said plurality of cam members and spaced along the length of said output shaft, said buzzer further comprising a plurality of said hammers corresponding respectively to said plurality of said resilient means, each of said projections provided respectively in said plurality of resilient means being engageable with a respective one of said plurality of cam members.

4. A buzzer according to claim 2, further comprising a mounting plate mounted on said body and having a row of retaining means, and a housing holding said motor therein with said output shaft extending exteriorly thereof, said resilient means being supported on said mounting plate, said housing having engaging means detachably engageable with a selected one of said retaining means.

5. A buzzer according to claim 4, in which said retaining means comprises a row of apertures formed through said mounting plate, said engaging means comprising at least one pair of pawls engageable with said aperture.

6. A buzzer according to claim 1, in which said cam member has a polygonal shape having an arcuate recess in each side thereof, said projection being of an arcuate shape convex toward said cam member and being receivable in said recess in each side of said polygonal cam member.

* * * * *